United States Patent [19]

Ratzkoff

[11] 4,046,382

[45] Sept. 6, 1977

[54] WORD GAME APPARATUS

[76] Inventor: George L. Ratzkoff, 6560 Racquet Club Drive, Lauderhill, Fla. 33319

[21] Appl. No.: 681,070

[22] Filed: Apr. 28, 1976

[51] Int. Cl.[2] ..... A63F 3/06

[52] U.S. Cl. ..... 273/135 B

[58] Field of Search ..... 273/135 B, 135 BC, 135 D, 273/135 AA, 135 AC; 35/35 H, 35 J

[56] References Cited

U.S. PATENT DOCUMENTS

| | | | |
|---|---|---|---|
| 1,685,723 | 9/1928 | Robins | 273/135 D |
| 3,413,004 | 11/1968 | Smith | 273/135 B |
| 3,464,124 | 9/1969 | Lynd | 273/135 B |
| 3,493,230 | 2/1970 | Curzon | 273/135 B |
| 3,602,513 | 8/1971 | Breen | 273/135 B |
| 3,633,914 | 1/1972 | Solomon | 273/135 B |
| 3,665,618 | 5/1972 | Hahn | 273/135 BC |
| 3,690,668 | 9/1972 | Weeks et al. | 273/135 B |
| 3,749,404 | 7/1973 | Oetzel | 273/135 B |
| 3,873,095 | 3/1975 | Nehre | 273/130 B |

FOREIGN PATENT DOCUMENTS

| | | | |
|---|---|---|---|
| 491,948 | 4/1953 | Canada | 273/135 B |

OTHER PUBLICATIONS

"Finger-Tip Bingo;" *Regal Games Catalog;* 1970.

*Primary Examiner*—Anton O. Oechsle
*Assistant Examiner*—Harry G. Strappello

[57] ABSTRACT

The present invention provides a game apparatus preferably named "COIN-O" which includes a plurality of playing boards having words from specific topics arranged in rows and column thereon. Each word has the same number of letters and the letters of each word fall in consecutive columns each column having a numerical value. A plurality of markers are provided to cover the letters on the board. One player called a "banker" picks a card from a deck, each card including a combination of a letter of the alphabet and a numerical value. The players cover the corresponding letters on their boards and the banker covers a corresponding position on a master board having a series of adjacent columns labelled with numerical values and having a consecutive list of the alphabet therein. The playing boards include definitions of the back face thereof defining the words displayed on the front surface of the playing boards. A score card is provided to record the players' scores.

10 Claims, 5 Drawing Figures

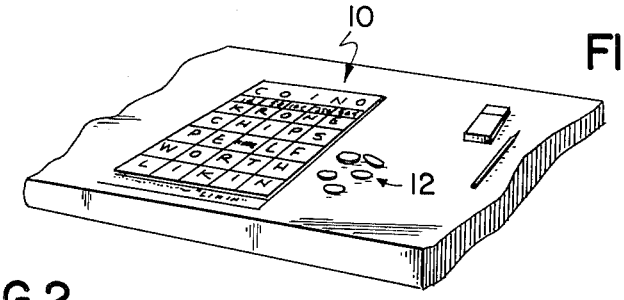
FIG. 1
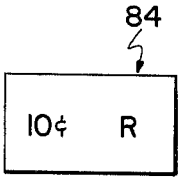
FIG. 5
FIG. 2
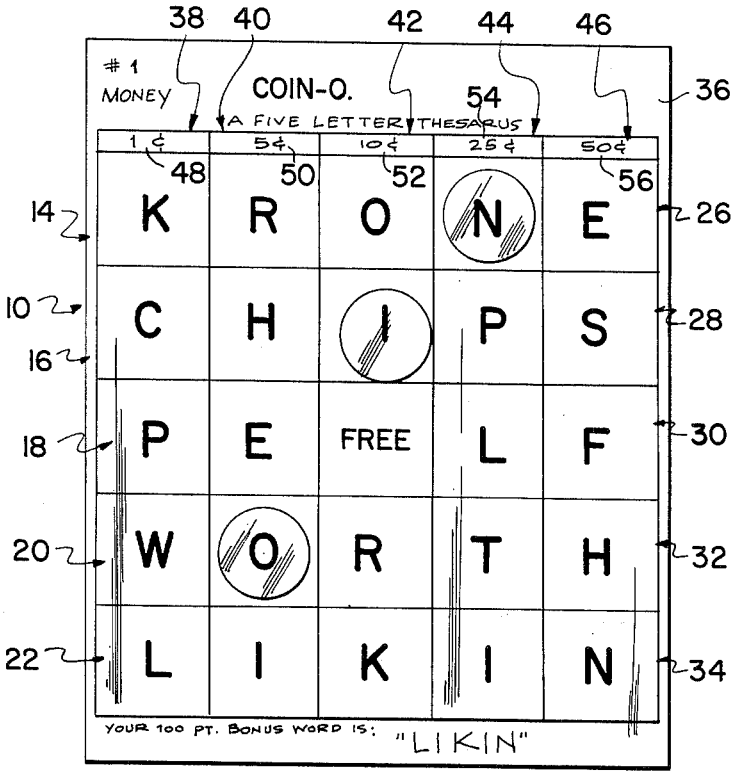
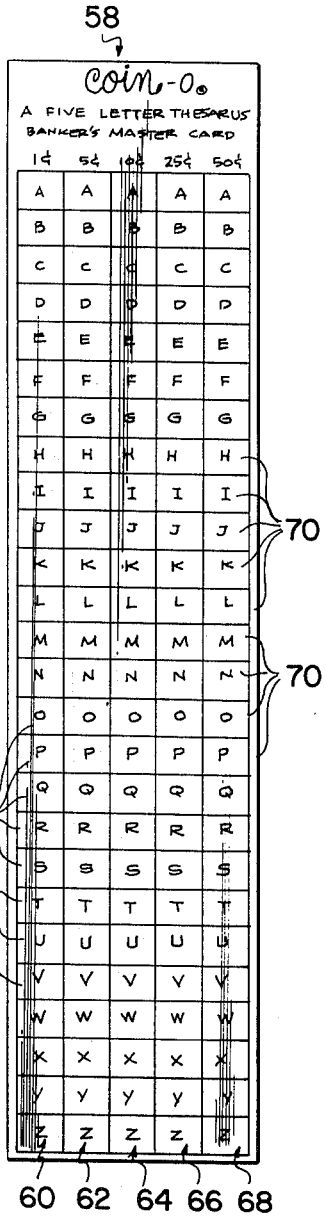
FIG. 3
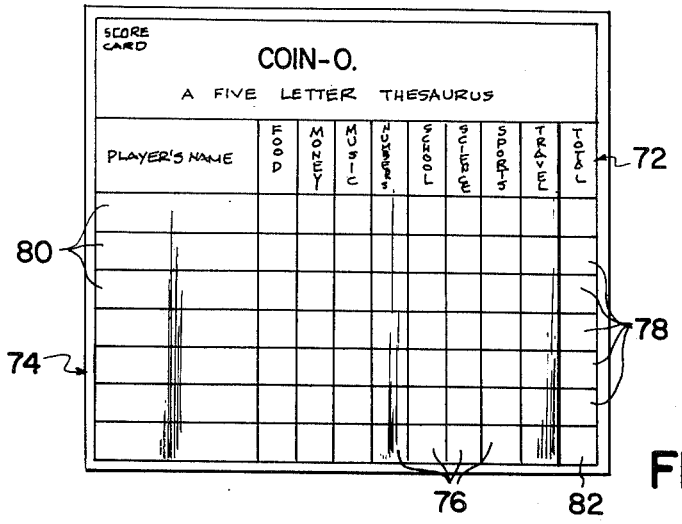
FIG. 4

WORD GAME APPARATUS

BACKGROUND OF THE INVENTION

1. Field of the Invention

The present invention relates to game apparatuses, and more particularly to a game apparatus for playing a competitive scoring game involving adding of monetary values, addition, familiarization with vocabulary and definition and the spelling of words by the players.

2. Description of the Prior Art

The prior art includes several games which develop word skills and several games which develop mathematical abilities. The present invention combines word skills and mathematical skills with chance thereby presenting a game which is educational as well as entertaining and which may be played by several players. The present invention also provides definitions of the words used therein thereby providing a further educational opportunity. Several word games in the prior art include various elements such as tokens, dice, or the like having indicia disposed thereon which, if lost, alter the playability of these games. All indicia necessary to the playing of the present invention is disposed on the playing boards thereof.

SUMMARY OF THE INVENTION

Therefore, it is a primary object of the present invention to provide a game apparatus which requires in the playing thereof adding of monetary values of the players.

A further object is to provide a game apparatus which requires in the playing thereof the familiarization of the user with vocabulary words, their definitions and spelling.

A still further object is to provide a game apparatus which is competitive.

A further object is to provide a factor of chance in the playing of the game apparatus.

These objects, as well as further objects and advantages, of the present invention will become readily apparent after reading the description of a non-Limiting illustrative embodiment and the accompanying drawing.

The present invention provides a game apparatus preferably named "COIN-O" which includes a plurality of playing boards having words from specific topics arranged in rows and columns thereon. Each word has the same number of letters and the letters of each word fall in consecutive columns each column having a numerical value. A plurality of markers are provided to cover the letters on the board. One player called a "banker" picks a card from a deck, each card including a combination of a letter of the alphabet and a numerical value. The players cover the corresponding letters on their boards and the banker covers a corresponding position on a master board having a series of adjacent columns labelled with numerical values and having a consecutive list of the alphabet therein. The playing boards include definitions of the back face thereof defining the words displayed on the front surface of the playing boards. A score card is provided to record the players' scores.

BRIEF DESCRIPTION OF THE DRAWINGS

In order that the present invention may be fully understood it will now be described, by way of example, with to the accompanying drawings in which:

FIG. 1 illustrates a pictoral representation of the preferred embodiment of the present invention;

FIG. 2 illustrates a front view of a playing board;

FIG. 3 illustrates a front view of the master board;

FIG. 4 illustrates a front view of the score board; and

FIG. 5 illustrates a front view of a card.

DESCRIPTION OF THE PREFERRED EMBODIMENT

Referring now to the figures, and more particularly to FIGS. land 2, there is illustrated therein a typical playing board 10 and a plurality of markers 12. The playing board 10 includes a series of words 14, 16, 18, 20 and 22 pertaining to a specific topic as illustrated at 24. The words 14, 16, 18, 20, and 22 are listed horizontally in a plurality of rows 26, 28, 30, 32, and 34 and are disposed on the front face 36 of the playing board 10. The words 14, 16, 18, 20, and 22 have an equal number of letters preferably five in number and are arranged in the columns 38, 40, 42, 44 and 46 which are labelled with numerical values preferably in the form of the monetary sums — 1¢, 5¢, 10¢, 25¢ and 50¢ designated 48, 50, 52, 54, and 56 respectively. The words 14, 16, 18, 20, and 22 are arranged in the columns 38, 40, 42, 44, and 46 with the letters of each word occupying the same serial position falling in the same column. There preferably is an odd number of words and columns with the median row 30 having a word with one less letter than the words 14, 16, 18, 20, and 22 in the rows 26, 28, 32, and 34 and the median column 42 in the space 56 in common with the median row 30 having "FREE" disposed therein.

The rear face of the playing board 10 not shown includes thereon a definition of the words 14, 16, 18, 20, and 22. Each of said playing boards 10 preferably further include on the lowermost portion there of the indicia "your 100 point bonus word is" followed by one of the words 14, 16, 18, 20, and 22. The words 14, 16, 18, 20, and 22 are selected from the same topic, the topics preferably including food, money, music, numbers, school, science, sports, and travel.

FIG. 3 illustrates a master board 58 including a plurality of juxtaposed columns 60, 62, 64, 66, and 68 each having one of the monetary sums 48, 50, 52, 54, and 56 disposed at the uppermost portion of the columns 60, 62, 64, 66, and 68 each column having therein in sequential order the letters of the alphabet 70.

FIG. 4 illustrates a scoreboard 72 with a grid 74 disposed thereon forming vertical rows 76 and horizontal columns 78. The vertical rows 76 are labelled with the topics and the horizontal columns are adapted to receive the players names 80 thereon. The vertical column 82 furthermost from the names 80 is labelled "total". The score board 72 is preferably manufactured of a material which may be marked, erased, and reused.

FIG. 5 illustrates a typical sample 84 of a plurality of cards each having thereon a random combination of one of the monetary sums 48, 50, 52, 54, 56 and a letter of the alphabet.

The uppermost portions of the playing boards 10, the master board 58, and the score board 72 preferably include the indicia "COIN-O" and juxtaposed thereunder the indicia "A FIVE letter thesaurus." The game apparatus preferably includes an instruction booklet, not shown, which includes rules and playing procedures.

In use, one — layer known as the "banker" selects a topic and distributes a playing board with words from that topic to each player. The plurality of markers are placed within easy reach of all players. The name of each player is placed on the score card 72 in the rows 80. A marker is placed over the word "FREE" on the boards 10. The banker shuffles the cards 84 and turns them over one at a time calling out the indicia thereon such as 10¢ — A or 25¢ — T. Each player then covers a corresponding letter in the column labelled with a corresponding monetary sum with a marker, if possible. The banker also places a marker over the corresponding letter on the master board 58. The banker calls other cards 84 until one player covers five letters in a row vertically, horizontally, or diagonally. The banker verifies the covered letters by checking the master board 58. The monetary values of the columns in which the letters of the winning word falls are added up and the sum is placed adjacent the players name in the column corresponding to the proper topic. All players keep their playing boards intact and the play continues until the word adjacent BONUS COIN-O is covered. The player who covers his bonus word receives 100 points which is marked on the score board and he becomes the banker for a new round. Another topic of playing cards are passed out to the players and the game continues until all topics have been used. The scores are totalled and the player with the highest sum wins.

It will be understood that various changes in the details, materials, arrangements of parts and operation conditions which have been herein described and illustrated in order to explain the nature of the invention may be made by those skilled in the art within the principles and scope of the invention.

Having thus set forth the nature of the invention, what is claimed is:

1. A game apparatus comprising:

a plurality of playing boards each having (comprising) a series of words (pertaining to the same topic) listed in a plurality of rows horizontally (and) disposed on the front face thereof, said words all comprising an equal number of letters and arranged in columns with said letters which occupy the same serial position in each of said words falling in the same column, each of said columns labelled with a numerical value, the rear face of said boards having said words and the definitions thereof disposed thereon the playing boards being divided into a plurality of sets wherein the playing boards within a set contain words pertaining to one specific topic, each playing board within a set having a unique arrangement of words;

a master board comprising a plurality of juxtaposed (justaposed) columns each having one of said numerical values at the top of each of said columns and the letters of the alphabet in sequential order listed in each column;

a score board with a grid disposed thereon the vertical rows thereof labelled with said topics (categories) and horizontal rows adapted to receive therein the players names, the vertical column furthermost from said names labelled "total";

a plurality of markers; and a plurality of cards comprising random combinations of said numerical values and the letters of the alphabet disposed thereon.

2. The game apparatus as claimed in claim 1, wherein said words comprise 5 letters.

3. The game apparatus as claimed in claim 1, wherein each of said playing boards contain an odd number of words and an odd number of columns, the median row having a word with one less letter than the other said words, the median column intersecting said median row having "FREE" disposed therein.

4. The game apparatus as claimed in claim 1, wherein said numerical values comprise monetary sums.

5. The game apparatus as claimed in claim 4, wherein said monetary sums comprise "1¢", "5¢", "10¢", "25¢", and "50¢".

6. The game apparatus as claimed in claim 1, wherein each of said playing boards comprise one of said words disposed thereon also disposed on the lowermost portion of said front face adjacent to the indicia "YOUR 100 POINT BONUS WORD IS".

7. The game apparatus as claimed in claim 1, wherein said topics comprise food, money, music, number, school, science, sports, and travel.

8. The game apparatus as claimed in claim 1, wherein said playing boards, said master board, and said score board comprise at the uppermost portions thereof the indicia "COIN-O" and juxtaposed thereunder the indicia "A FIVE LETTER THESAURUS."

9. The game apparatus as claimed in claim 1, wherein said score board comprises a material which may be marked, erased, and reused.

10. The game apparatus as claimed in claim 1, comprising an instruction booklet.

* * * * *